US005530978A

United States Patent [19]

Johenning

[11] Patent Number: 5,530,978

[45] Date of Patent: Jul. 2, 1996

[54] SOFTSIDED WATERBED WITH INTERCHANGEABLE COVER

[75] Inventor: John B. Johenning, Beverly Hills, Calif.

[73] Assignee: Strata Flotation, Inc., Torrance, Calif.

[21] Appl. No.: 207,731

[22] Filed: Mar. 8, 1994

[51] Int. Cl.[6] ..... A47C 27/08

[52] U.S. Cl. ..... 5/451; 5/470

[58] Field of Search ..... 5/451, 449, 450, 5/452, 470, 500, 502, 496, 498

[56] References Cited

U.S. PATENT DOCUMENTS

| | | | |
|---|---|---|---|
| 1,375,061 | 4/1921 | Nyhus | 5/470 |
| 2,348,807 | 5/1944 | Goodstein | 5/502 |
| 2,789,292 | 4/1957 | Budinquest | 5/496 |
| 3,179,958 | 4/1965 | Carris | 5/496 |
| 4,371,998 | 2/1983 | Callaway | 5/451 |
| 4,389,743 | 6/1983 | Callaway | 5/470 |
| 4,449,261 | 5/1984 | Magnusson | 5/470 |
| 4,809,375 | 3/1989 | Bull | 5/470 |
| 5,109,559 | 5/1992 | West | 5/470 |

*Primary Examiner*—Alexander Grosz
*Attorney, Agent, or Firm*—Flehr, Hohbach, Test, Albritton & Herbert

[57] ABSTRACT

Softsided waterbed having an interchangeable cover which is reversible and/or readily replaced with another cover. In the embodiment disclosed, the interchangeable cover has fill materials of different weights toward opposite sides thereof, and the bed has a different feel and/or visual appearance depending upon which side of the cover is facing up. The cover is releasably secured to the rest of the bed by fasteners such as buttons which permit the cover to be readily reversed or replaced.

15 Claims, 1 Drawing Sheet

SOFTSIDED WATERBED WITH INTERCHANGEABLE COVER

This invention pertains generally to waterbeds and, more particularly, to waterbeds of the type known as "softsided" or hybrid waterbeds.

Softsided or hybrid waterbeds have a water filled bladder surrounded by foam rails or cushions, and may also have foam pads below and/or above the bladder. A quilted cover encloses the other components and gives the bed the outward appearance of a conventional innerspring mattress. The quilted cover is an integral part of the bed, and cannot be readily changed in the event that one wishes to give the bed a different visual appearance or a different feel.

It is in general an object of the invention to provide a new and improved softsided waterbed.

Another object of the invention is to provide a softsided waterbed of the above character in which the quilted cover can be readily changed to give the bed a different visual appearance or feel.

These and other objects are achieved in accordance with the invention by providing a softsided waterbed with an interchangeable cover which is reversible and/or readily replaced with another cover. In the embodiment disclosed, the removable cover has fill materials of different weights toward opposite sides thereof, and the bed has a different feel and/or visual appearance depending upon which side of the cover is facing up. The removable cover is releasably secured to the rest of the bed by means such as buttons which permit the cover to be readily reversed or replaced.

Figure 1:
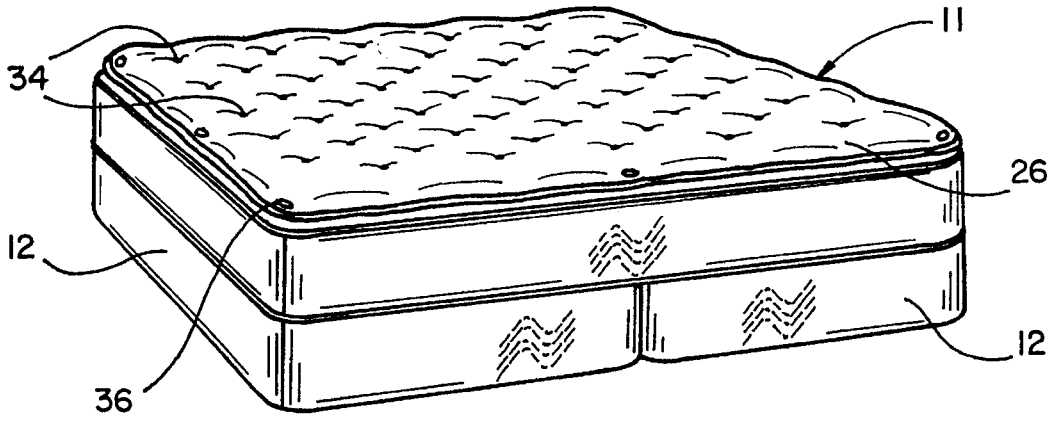
FIG. 1 is an isometric view of one embodiment of a waterbed incorporating the invention.
Figure 2:
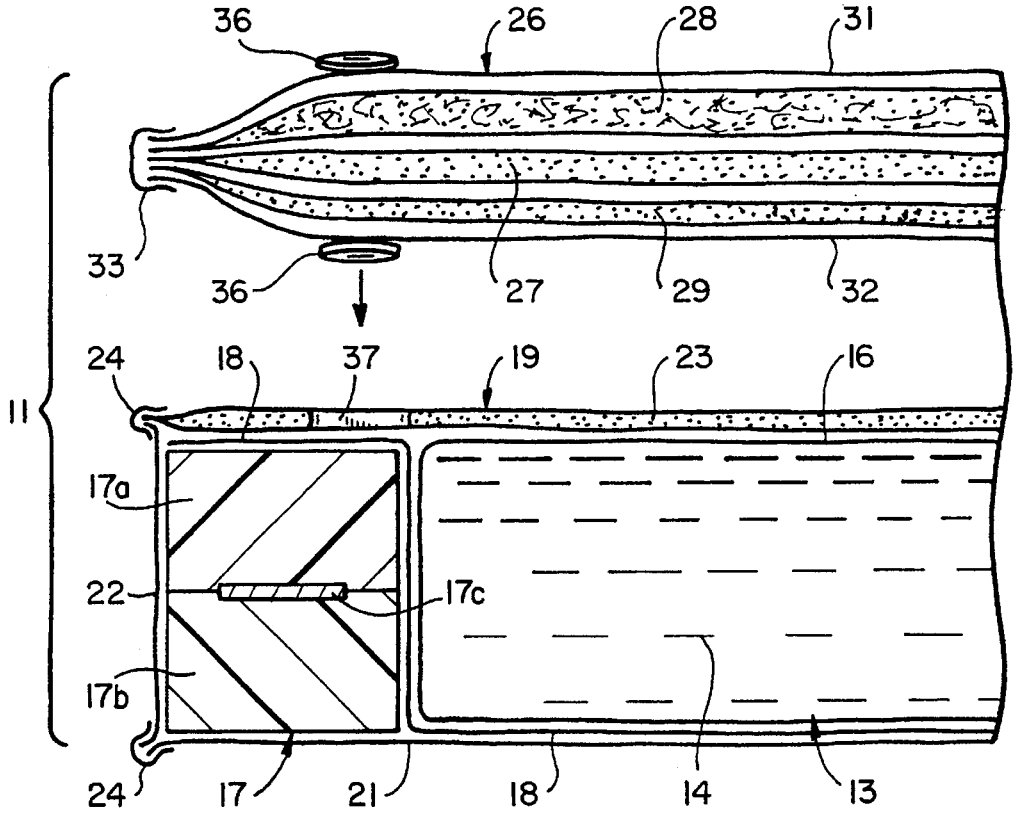
FIG. 2 is an exploded, fragmentary cross-sectional view of the embodiment of FIG. 1, with thickness of the materials exaggerated for clarity of illustration.

As illustrated in the drawings, the waterbed has a generally rectangular mattress 11 which rests on a pair of conventional foundation units 12. The mattress has a bladder 13 of flexible material which contains a body of water 14. The bladder has a horizontally extending upper wall 16 which serves as a sleeping surface for receiving persons resting on the mattress.

Foam rails or cushions 17 extend around the lateral periphery of the bladder and form a resilient circumscribing frame for the mattress. Each of the rails consists of two cushions 17*a*, 17*b* of foam material, with an elongated reinforcing element 17*c* extending longitudinally thereof. The reinforcing elements are in the form of flat bars of spring steel or plastic, and the elements in adjacent ones of the rails are connected together at the corners of the bed in a manner which permits longitudinal movement of the elements relative to each other. This rail structure is disclosed in greater detail in Ser. No. 08/106,338, filed Aug. 13, 1993, now U.S. Pat. No. 5,416,937 and gives the frame formed by the rails some flexibility which enables the corners of the bed to be lifted more easily when the bed is being made.

The foam rails have a height or thickness corresponding to the thickness of the mattress, and in the embodiment illustrated, the water filled bladder has a similar thickness or depth. Alternatively, depending upon the effect desired, a bladder of lesser thickness or depth can be employed, with foam pads (not shown) above and/or below the bladder.

A safety liner 18 consisting of a sheet of water impervious material extends beneath the bladder and along the inner and upper faces of the rails to contain any water which may happen to leak out of the bladder within the mattress.

An enveloping cover 19 encloses the bladder and rails and gives the mattress the appearance of a conventional innerspring mattress. This cover has a lower panel 21 which extends beneath the bladder and rails, a side panel 22 which extends along the outer sides of the rails, and an upper panel 23 which overlies the rails and the sleeping surface of the bladder. The panels are held together by binding tape 24 and stitching (not shown) along the upper and lower peripheral edges of the mattress.

In the embodiment illustrated, side panel 22 and upper panel 23 are quilted by stitching along lines arranged in a wave-like pattern, and the side panels of foundation units 12 have a similar quilted appearance.

A cover 26 is removably mounted on the upper panel of the enveloping cover and can be reversed or replaced to give the mattress a different visual appearance and/or feel. This cover overlies the sleeping surface and has a lateral extent substantially coextensive with the upper surface of the mattress.

The removable cover has an inner layer 27 of polyester filler material, with a layer 28 of a heavier, bulkier material on one side of the polyester layer, and a layer 29 of a lighter, less bulky material on the other. The heavier material is a material such as wool which traps more air and gives that side of the cover a warmer feeling. The lighter material is a material such as cotton or silk which traps less air and has a cooler feeling than the wool. Sheets 31, 32 of damask material such as cotton overlie the outer layers of filler material, and the sheets and filler materials are secured together around the edges by binding tape 33 and stitching (not shown). In the embodiment illustrated, a plurality of buttons 36 are arranged in a pattern on opposite sides of the cover and tied together to give the cover a tufted appearance. Alternatively, the cover can be stitched together along lines giving it a quilted appearance.

If different visual appearances are desired, the two sheets of damask material can be of different colors and/or patterns, or can be different types of material.

The removable cover 26 is releasably secured to the upper panel 23 of the enveloping cover by a plurality of buttons 36 which are spaced about the periphery of the removable cover. In the embodiment illustrated, the buttons are provided in corresponding positions on both sides of the removable cover and are received in buttonholes 37 formed in upper panel 23. Alternatively, if desired, the buttons can be affixed to panel 23, and the buttonholes can be formed in the removable cover.

While the buttons are the presently preferred means for securing the removable cover to the rest of the mattress, other suitable type of fasteners can also be employed for that purpose. Such fasteners include snaps, zippers and hook and loop type fasteners such as the ones sold under the trademark Velcro.

The feel of the sleeping surface is largely determined by the filler materials in the removable cover. In the embodiment described above, for example, the heavier or bulkier material (wool) gives the mattress a warmer feel and is more suitable for winter use and colder climates, whereas the lighter or less bulky material (cotton or silk) give the mattress a cooler feel and is more suitable for summer use and warmer climates. By including the two materials in the same cover, the mattress can be changed for seasonal use simply by turning the cover over. If other feels or appearances are desired, the cover can be replaced with one having the appropriate materials or appearance.

It is apparent from the foregoing that a new and improved waterbed has been provided. While only one presently preferred embodiment has been described in detail, as will be apparent to those familiar with the art, certain changes and modifications can be made without departing from the scope of the invention as defined by the following claims.

I claim:

1. In a waterbed: a water-filled bladder of flexible material having a horizontally extending upper surface, a cushion of resilient material extending peripherally of the bladder, an enveloping cover of flexible material enclosing the bladder and the cushion and having an upper panel which overlies the upper surface of the bladder and the peripheral cushion, a removable cover overlying the upper panel of the enveloping cover and having layers of heavier and lighter filler materials toward opposite sides thereof, and means releasably securing the removable cover to the upper panel of the enveloping cover and permitting the removable cover to be selectively oriented with either the heavier filler material or the lighter filler material on top.

2. The waterbed of claim 1 wherein the removable cover has different visual appearances on the opposite sides thereof.

3. The waterbed of claim 1 wherein the means releasably securing the removable cover to the upper panel comprises a series of buttons spaced about the periphery of the removable cover.

4. The waterbed of claim 3 wherein the buttons are affixed to the removable cover and are adapted to be received in buttonholes in the upper panel of the enveloping cover.

5. The waterbed of claim 1 wherein the means releasably securing the removable cover to the upper panel is selected from the group consisting of buttons, snaps, zippers and, hook and loop fasteners.

6. The waterbed of claim 1 wherein the heavier filler material is wool.

7. The waterbed of claim 6 wherein the lighter material is selected from the group consisting of cotton and silk.

8. The waterbed of claim 1 wherein the lighter filler material is selected from the group consisting of cotton and silk.

9. In a waterbed:

a flexible water filled bladder having a horizontally extending upper surface;

a cushion of resilient material extending peripherally of the bladder;

an enveloping cover enveloping the bladder and the cushion and having an upper panel which overlies the upper surface of the bladder and the peripheral cushion;

a removable cover overlying the upper panel of the enveloping cover and having a layers of relatively heavy and relatively light filler materials toward opposite sides thereof; and a plurality of buttons releasably securing the removable cover to the upper panel of the enveloping cover and permitting the removable cover to be selectively oriented with either the heavier filler material or the lighter filler material on top.

10. The waterbed of claim 9 wherein the buttons are affixed to the removable cover and received in buttonholes in the upper panel of the enveloping cover.

11. The waterbed of claim 9 wherein the heavier filler material is wool.

12. In a bed: a mattress having an enveloping cover with a horizontally extending upper surface, a removable cover overlying the upper surface and having a lateral extent substantially coextensive with the upper surface, a plurality of buttons spaced about the periphery of the removable cover in corresponding positions on opposite sides of the removable cover, and a plurality of buttonholes in the upper panel of the enveloping cover for receiving the buttons on either side of the removable cover.

13. The waterbed of claim 12 wherein the removable cover has layers of heavier and lighter filler materials toward opposite sides thereof, sheets of damask material covering the filler materials, and means holding the sheets of damask material and the layers of filler material together.

14. The waterbed of claim 13 wherein the heavier filler material is wool.

15. The waterbed of claim 13 wherein the lighter filler material is selected from the group consisting of cotton and silk.

* * * * *